United States Patent [19]

Powell

[11] Patent Number: 4,740,074

[45] Date of Patent: Apr. 26, 1988

[54] FILM DEVELOPMENT SYSTEM

[76] Inventor: Charles S. Powell, 9 Logging Trail, Durham, N.C. 27707

[21] Appl. No.: 115,773

[22] Filed: Oct. 30, 1987

[51] Int. Cl.[4] ..... G03D 13/04

[52] U.S. Cl. ..... 354/337; 354/299; 354/313; 354/331

[58] Field of Search ..... 354/299, 307, 312, 313, 354/314, 316, 323, 329, 330, 331, 337, 335

[56] References Cited

U.S. PATENT DOCUMENTS

| | | | |
|---|---|---|---|
| 3,307,468 | 3/1967 | Briber . | |
| 3,368,472 | 2/1968 | Van Bouwel et al. . | |
| 3,698,307 | 10/1972 | Reichardt | 354/299 |
| 3,890,629 | 6/1975 | Huss | 354/299 |
| 4,153,363 | 5/1979 | Albano | 354/322 |
| 4,240,737 | 12/1980 | Lawson | 354/321 |
| 4,248,513 | 2/1981 | Caccamisi | 354/299 |
| 4,275,959 | 6/1981 | Jones | 354/299 |
| 4,332,456 | 6/1982 | Kaufmann | 354/299 |
| 4,350,429 | 9/1982 | Slavin | 354/299 |
| 4,364,655 | 12/1982 | Parker | 354/299 |
| 4,453,817 | 6/1984 | Clark | 354/299 |
| 4,533,225 | 8/1985 | Shiga | 354/322 |
| 4,600,287 | 7/1986 | Hotta et al. | 354/299 |

*Primary Examiner*—A. A. Mathews

*Attorney, Agent, or Firm*—Richard E. Jenkins

[57] ABSTRACT

A film development system including a container for development fluid, a lid for the container, a computer, a temperature sensing probe and a visual time display. The temperature sensing probe extends downwardly into the container and monitors the temperature of a development fluid therein. The temperature probe transmits data to the computer which is adapted to calculate the time remaining for a selected film development step corresponding to the temperature indicated by the temperature probe. The computer transmits signals to the visual display where the temperature of the development fluid and the time remaining until completion of the film development step are displayed.

20 Claims, 2 Drawing Sheets

FILM DEVELOPMENT SYSTEM

TECHNICAL FIELD

The present invention relates to film development systems and particularly to a portable film development system suitable for precise development of small batches of film.

BACKGROUND ART

Photographers often avoid the expense and risk associated with commercial film development by venturing into their own darkrooms in order to develop their exposed rolls of film. Proper film development in a private darkroom requires that the exposed film be subjected to a film development fluid for a specific period of time at a certain temperature. The time needed for development is inversely proportional to the temperature of the developing fluid, and the entire development process can involve multiple processing steps including agitation and changing of development fluids.

The photographer often does not have access to complex photographic developing equipment such as that disclosed in U.S. Pat. Nos. 4,364,655; 4,350,429; 4,332,456; 4,275,959; 4,453,817; and 4,600,287. Instead, the photographer must utilize a small portable film development tank and measure the temperature of the development solution and the time necessary for one or more development steps with a separate thermometer and clock. Therefore, film development often leads to inconsistent results stemming from inaccuracies in monitoring both the temperature of development fluids inside the tank and the time periods of film development steps. The film development system of the present invention eliminates the problems described above and provides the small-scale photographer with a simple yet accurate means of developing exposed film.

DISCLOSURE OF THE INVENTION

In accordance with the present invention, applicant provides a film development system designed specifically to provide accurate and consistent development results while avoiding the use of complex development equipment. The development system comprises a portable container for development fluid, a lid for the container, and an integral computer having an electrically connected temperature sensor and visual time display.

The lid is designed to maintain development fluids within the container while also being easily removable in order to facilitate the introduction of film to be developed, the changing of fluids, and the removal of film after the film development process. The computer is most preferably positioned within the lid, and the electrically connected temperature sensor depends downwardly from the lid into the container so as to come into contact with a development fluid contained within the tank.

Since different types of film have different time/temperature relationships for proper development, the specific time and temperature parameters of a development step are introduced by the user into the computer. The computer is adapted to then calculate the time remaining in the designated processing step given the temperature measured by the temperature sensor. The visual time display electrically connected to the computer indicates the temperature of the developing fluid and the calculated time remaining for development at that particular temperature. Alternately, the film development system of the present invention can be used to simply monitor the remaining time and the temperature during a film processing step and display this data on the visual time display without any processing of the time and temperature data by the computer.

It is therefore an object of the present invention to provide a film development system that facilitates accurate film development for the small-scale film developer.

More specifically, it is an object of the present invention to provide a film development system that automatically calculates and displays the time remaining in a film development process step according to the temperature of the development fluid.

Still another object of the present invention is to provide a film development system wherein both the time remaining in a film development process step and the temperature of the development fluid are displayed by the film development system so as to avoid the need for separate and tedious manual timing and temperature measuring activities by the user.

BRIEF DESCRIPTION OF THE DRAWINGS

Some of the objects of the present invention having been stated, other objects will become evident as the description proceeds when taken in connection with the accompanying drawings, in which.

BEST MODE FOR CARRYING OUT THE INVENTION

Figure 1:
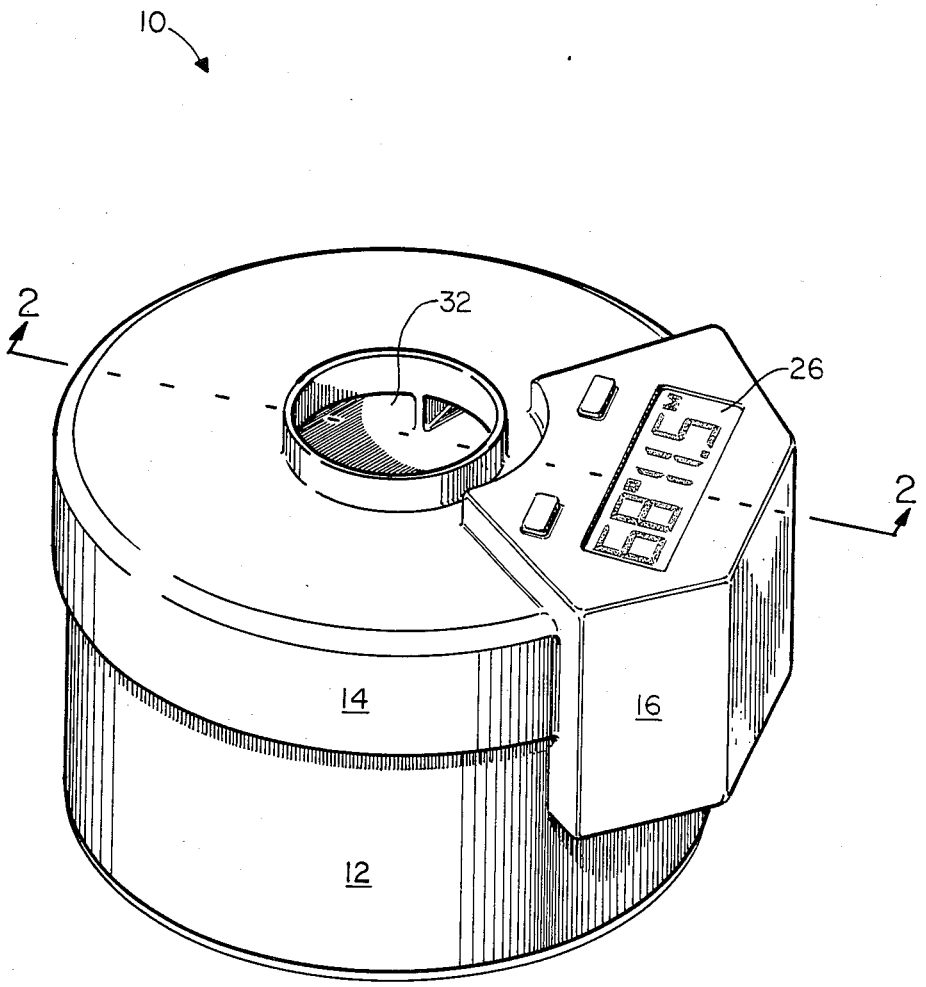
FIG. 1 is a perspective view of the film development system according to the present invention.
Figure 2:
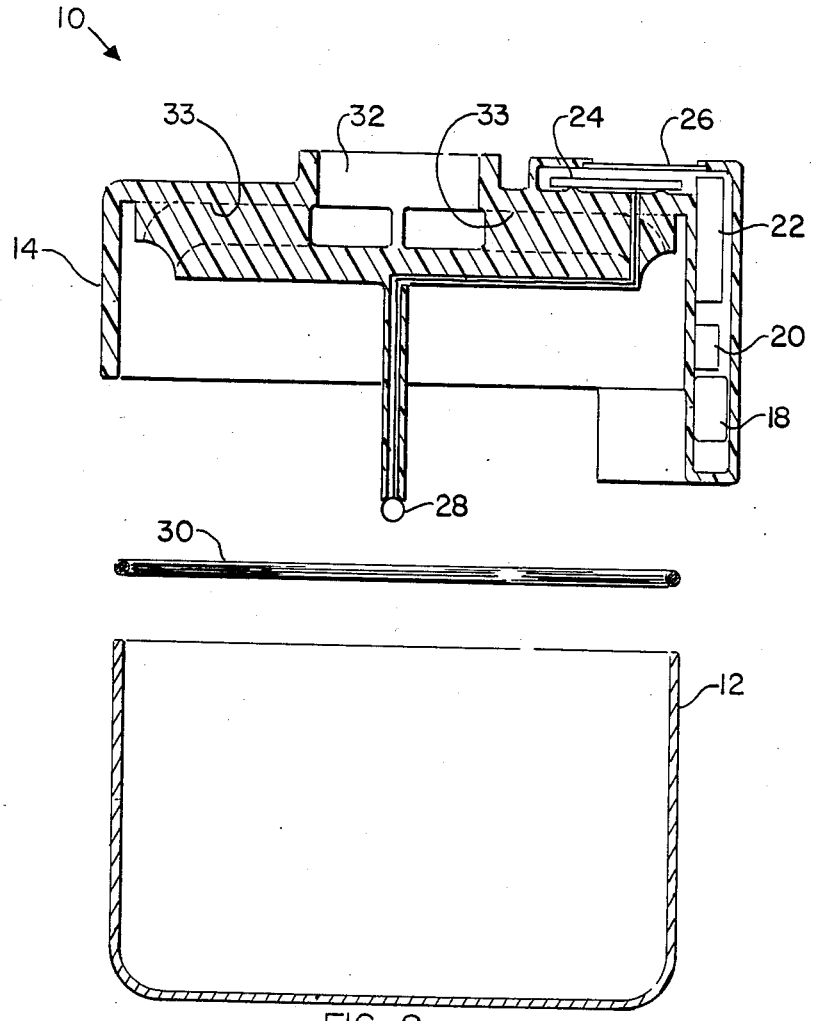
FIG. 2 is an exploded vertical cross section view of the film development system according to the present invention.
Figure 3:
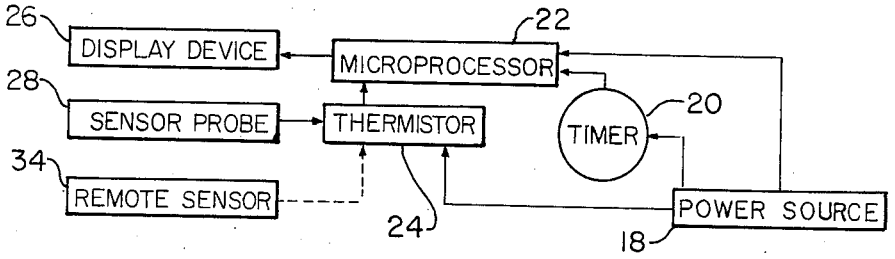
FIG. 3 is a schematic representation of the elements of the film development system shown in FIGS. 1 and 2.

Referring now more specifically to the drawings a preferred embodiment of the film development system according to the present invention is shown in FIGS. 1–3. FIG. 1 shows a perspective view of the film development system, generally designated 10, comprising development tank 12 and lid 14. Development tank 12 can be any portable film development tank well known in the art but is most preferably a stainless steel tank suitable for the development of small batches of film.

With reference now to FIG. 2, film development system 10 is shown in an exploded view to more clearly illustrate the elements thereof. Component housing 16 is integrally secured to lid 14 and contains a power source 18, a timing means 20, a computer means 22, a thermistor 24 and a display device 26. Computer means 22 is most preferably a microprocessor semiconductor chip. Display device 26 can be any type of visual display device well known in the art but is most preferably a liquid crystal display (LCD) device. Timing means 20 is most preferably an electronic quartz digital timer, and timer 20, microprocessor 22, and thermistor 24 are powered by power source 18 which is most suitably a disposable battery. Timer or clock 20 is electrically connected to microprocessor 22 so as to provide microprocessor 22 with timing capability. A temperature sensor probe 28 is secured to lid 14 and is electrically connected to thermistor 24 which is in turn electrically connected to microprocessor 22. Thermistor 24 serves to convert a heat signal from sensor probe 28 to an electrical signal for input to microprocessor 22. Temperature sensor probe 28 can be any suitable type of conventional temperature sensor. An O-ring 30 is provided to be positioned in slot 29 within lid 14 to form a fluid tight seal between lid 14 and tank 12 when development system 10 is in use. Aperture 32 and fluidly communicating passageways 33 in lid 14 facilitate the exchange of development fluids within development system 10 in a manner well known to those familiar with the film development art.

Although not shown in the drawings, tank 12 preferably contains a film-retaining spool to facilitate the retention of film in the tank in a spaced-apart helical configuration which allows the entire length of a film roll to be fully immersed in film development fluid. It should be observed that although timer or clock 20 is shown separate form microprocessor 22, it is also contemplated that timer 20 could be an integral part of the microprocessor 22 as a matter of design choice. It should be further observed that although the preferred embodiment of the invention shown in FIGS. 1 and 2 depicts the various components of the invention as secured within lid 14, the components could alternatively be secured to development tank 12.

FIG. 3 shows a schematic representation of the elements of the preferred embodiment of the present invention. Battery 18 is shown providing power to timer 20 and microprocessor 22. Temperature sensor probe 28 and thermistor 24 is shown supplying microprocessor 22 with information regarding the temperature of the development fluid. Microprocessor 22 and timer 20 work cooperatively in order to compute the time remaining in a development process step corresponding to the temperature indicated by sensor probe 28, and microprocessor 22 directs display device 26 to provide digital readings for both the temperature of the development fluid and the time remaining for development or completion of a development process step. FIG. 3 also shows a remote sensor 34 which could optionally be placed in another medium elsewhere in a photographic lab in order to remotely monitor that medium with the circuitry of the instant invention.

In operation, a roll of film to be developed is placed onto a film spool (not shown) and into tank 12 along with the appropriate development fluid and lid 14 is securely fastened to tank 12. Microprocessor 22 is programmed for the time/temperature relationship of the particular film to be developed, and timer 20 is activated. Temperature sensor probe 28 immediately transmits heat signals to thermistor 24 which in turn transmits electrical signal data to microprocessor 22. development of the film (or completion of the development step) at the temperature indicated by temperature sensor probe 28 and then transmits corresponding data signals to display device 26 so that both the time remaining for development and the temperature of the film development fluid are displayed by display device 26. Should any change in temperature take place during the development period, microprocessor 22 will compute the new time period remaining and transmit a corresponding signal to display device 26. When all requisite wet processing steps are performed on the film, lid 14 is opened and the spool of film is removed from tank 12 for subsequent processing into dry photographic prints.

Film development system 10 could also be suitably equipped with an alarm or buzzer to sound at the end of the development period and/or at the end of selected development steps, such as agitation and the like as a matter of design choice.

Microprocessor 22 could alternately be programmed by the user to directly transmit time and temperature information to display device 26 without performing computations therewith. In this particular operating mode, microprocessor 22 is programmed for a preset time period. Microprocessor 22 relays data signals to display device 26 corresponding to the time remaining in the preset time period, and display device 26 in turn displays the time remaining in the preset time period along with the temperature of the development fluid. An operator would normally pre-program the time period corresponding to the initial temperature of the development fluid and microprocessor 22 would not make any adjustments to the remaining time read-out during film development even if the temperature of the development fluid should change.

The present film development system effectively eliminates the need to perform tedious and often inaccurate manual timing and temperature measurements during photographic film development by providing an integral temperature sensor probe and microprocessor to automatically calculate the exact time remaining in a development step according to the temperature of the development fluid during development of the film and to then adjust the time in accordance with any temperature variation during the development step. The present system thereby allows the photographer to consistently and accurately develop small batches of film without the aid of a commercial developer or the use of complex photographic development equipment.

It will be understood that various details of the invention may be changed without departing from the scope of the invention. Furthermore, the foregoing description is for the purpose of illustration only, and not for the purpose of limitation—the invention being defined by the claims.

What is claimed is:

1. A portable film development tank of the type having a container for development fluids, a film-retaining spool member removably positioned within said container, and a removable lid, wherein the improvement comprises providing:

temperature sensing means extending into said container for sensing the temperature of a development fluid therein;

computer means electrically connected to said temperature sensing means for receiving signals corresponding to the temperature of the development fluid from said temperature sensing means and adapted to be programmed to determine the time required to complete a selected film processing step as a function of said development fluid temperature;

display means electrically connected to said computer means for receiving time data signals from said computer means and displaying said time data; and power source means electrically associated with said computer means for providing electrical power thereto.

2. A portable film development tank according to claim 1 wherein the temperature sensing means includes a temperature probe.

3. A portable film development tank according to claim 2 wherein the temperature sensing means includes a thermistor electrically connected to said temperature probe.

4. A portable film development tank according to claim 1 wherein the computer means is a microprocessor.

5. A portable film development tank according to claim 4 including a timing means electrically connected to said microprocessor.

6. A portable film development tank according to claim 1 wherein the display means is a liquid crystal display device.

7. A portable film development tank according to claim 1 wherein the power source means is a battery.

8. A portable film development tank according to claim 1 wherein the temperature sensing means, the computer means and the display means are secured to the lid of the development tank.

9. A portable film development tank comprising:

a container for development fluids adapted to receive a removable film-retaining spool member;

a lid removably secured to said container;

temperature sensing means extending into said container for sensing the temperature of a development fluid therein;

computer means electrically connected to said temperature sensing means for receiving signals corresponding to the temperature of the development fluid from said temperature sensing means and adapted to be programmed to determine the time required to complete a selected film processing step as a function of said development fluid temperature;

display means electrically connected to said computer means for receiving time data signals from said computer means and displaying said time data; and power source means electrically associated with said computer means for providing electrical power thereto.

10. A portable film development tank according to claim 9 wherein the temperature sensing means includes a temperature probe.

11. A portable film development tank according to claim 10 wherein the temperature sensing means includes a thermistor electrically connected to said temperature probe.

12. A portable film development tank according to claim 9 wherein the computer means is a microprocessor.

13. A portable film development tank according to claim 12 including a timing means electrically connected to said microprocessor.

14. A portable film development tank according to claim 9 wherein the display means is a liquid crystal display device.

15. A portable film development tank according to claim 9 wherein the power source means is a battery.

16. A portable film development tank according to claim 9 wherein the temperature sensing means, the computer means and the display means are secured to the lid of the development tank.

17. A portable film development tank comprising:

a container for development fluids adapted to receive a removable film-retaining spool member;

a lid removably secured to said container;

a temperature probe secured to said lid and extending generally downwardly into said container for sensing the temperature of a development fluid therein;

a microprocessor electrically connected to said temperature probe for receiving signals corresponding to the temperature of the development fluid from said temperature probe and adapted to be programmed to determine the time required to complete a selected film processing step as a function of said development fluid temperature;

a liquid crystal display device electrically connected to said microprocessor for receiving time data signals from said microprocessor and displaying said time data; and a battery electrically associated with said microprocessor for providing electrical power thereto.

18. A portable film development tank according to claim 17 wherein said temperature probe includes a thermistor electrically connected thereto and to which said microprocessor is electrically connected.

19. A portable film development tank according to claim 17 wherein said microprocessor includes a timing means electrically connected thereto.

20. A portable film development tank according to claim 19 wherein said timing means comprises a quartz clock.

* * * * *